US007770749B2

(12) United States Patent
Lin

(10) Patent No.: US 7,770,749 B2
(45) Date of Patent: Aug. 10, 2010

(54) COVER SET

(76) Inventor: Tsong-Yow Lin, No. 57-1, Yung Ho Street, Yung Ho Village, Ta Tu Hsiang, Taichung Hsien (TW)

( * ) Notice: Subject to any disclaimer, the term of this patent is extended or adjusted under 35 U.S.C. 154(b) by 492 days.

(21) Appl. No.: 11/469,293

(22) Filed: Aug. 31, 2006

(65) Prior Publication Data

US 2008/0067083 A1 Mar. 20, 2008

(51) Int. Cl.
*B65D 51/04* (2006.01)

(52) U.S. Cl. ..... 220/254.5; 220/827; 220/908

(58) Field of Classification Search ..... 220/829, 220/830, 254.3, 254.5, 908, 831, 840, 260, 220/263, 264, 810, 820, 827; 206/139; 16/282, 16/54, 50, 283, 284, 250, 255; 49/383
See application file for complete search history.

(56) References Cited

U.S. PATENT DOCUMENTS 4,787,121 A * 11/1988 Racenis et al. ..... 16/356
6,497,073 B2 * 12/2002 Webb ..... 49/383
6,513,196 B2 * 2/2003 Snowden et al. ..... 16/268
6,857,538 B2 * 2/2005 Lin ..... 220/830
2004/0159010 A1 * 8/2004 Hwang ..... 34/601
2004/0159661 A1 * 8/2004 Aochi ..... 220/264
2005/0108853 A1 * 5/2005 Lee ..... 16/330

* cited by examiner

*Primary Examiner*—Anthony Stashick
*Assistant Examiner*—Jeffrey Allen
(74) *Attorney, Agent, or Firm*—Alan Kamrath; Kamrath & Associates PA

(57) ABSTRACT

A cover set includes a ring mounted on a bin, a cover pivotally connected to the ring, a lifting device for lifting the cover from the ring and at least one buffer for buffering the cover near the end of the lifting so that the lifting is steady and quiet from the start to the end.

17 Claims, 11 Drawing Sheets

COVER SET

BACKGROUND OF INVENTION

1. Field of Invention

The present invention relates to a garbage-containing apparatus and, more particularly, to a cover set for a garbage-containing apparatus.

2. Related Prior Art

Referring to FIG. 11, a conventional garbage-containing apparatus 90 is shown to include a bin 92, a cover 91 pivotally connected to the bin 92 and two elastic elements 93 for lifting the cover 91 from the bin 92. Near the end of the lifting, the cover 91, however, hits the bin 92 fiercely and makes a loud noise. The hit is often strong so that the entire garbage-containing apparatus rattles and makes more noise. Such noise is annoying.

The present invention is therefore intended to obviate or at least alleviate the problems encountered in the prior art.

SUMMARY OF INVENTION

According to the present invention, a cover set includes a ring mounted on a bin, a cover pivotally connected to the ring, a lifting device for lifting the cover from the ring and at least one buffer for buffering the cover near the end of the lifting.

The primary advantage of the garbage-containing apparatus according to the present invention is quietness during the lifting from the start to the end.

Other advantages and features of the present invention will become apparent from the following description referring to the drawings.

BRIEF DESCRIPTION OF DRAWINGS

The present invention will be described through detailed illustration of three embodiments referring to the drawings.

DETAILED DESCRIPTION OF EMBODIMENTS

Figure 1:
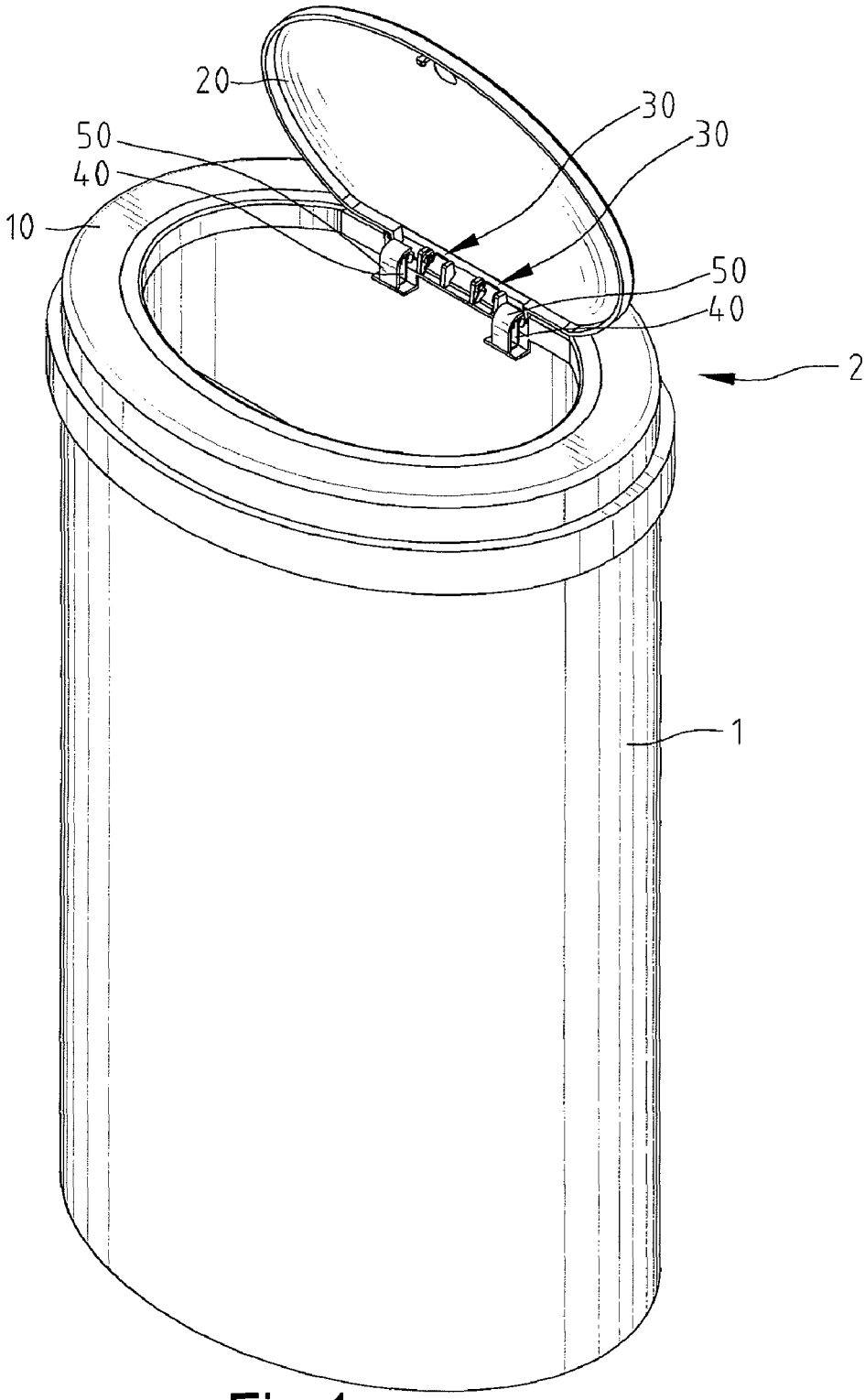
FIG. 1 is a perspective view of a garbage-containing apparatus equipped with a cover set according to the first embodiment of the present invention.

Referring to FIG. 1, there is shown a garbage-containing apparatus including a bin 1 and a cover set 2 according to a first embodiment of the present invention. The cover set 2 includes a ring 10 mounted on the bin 1, a cover 20 pivotally connected to the ring 10, a lifting device 30 for lifting the cover 20 from the ring 10, two buffers 40 for buffering the cover 20 near the end of the lifting and two shields 50 for shielding the buffers 40.

Figure 2:
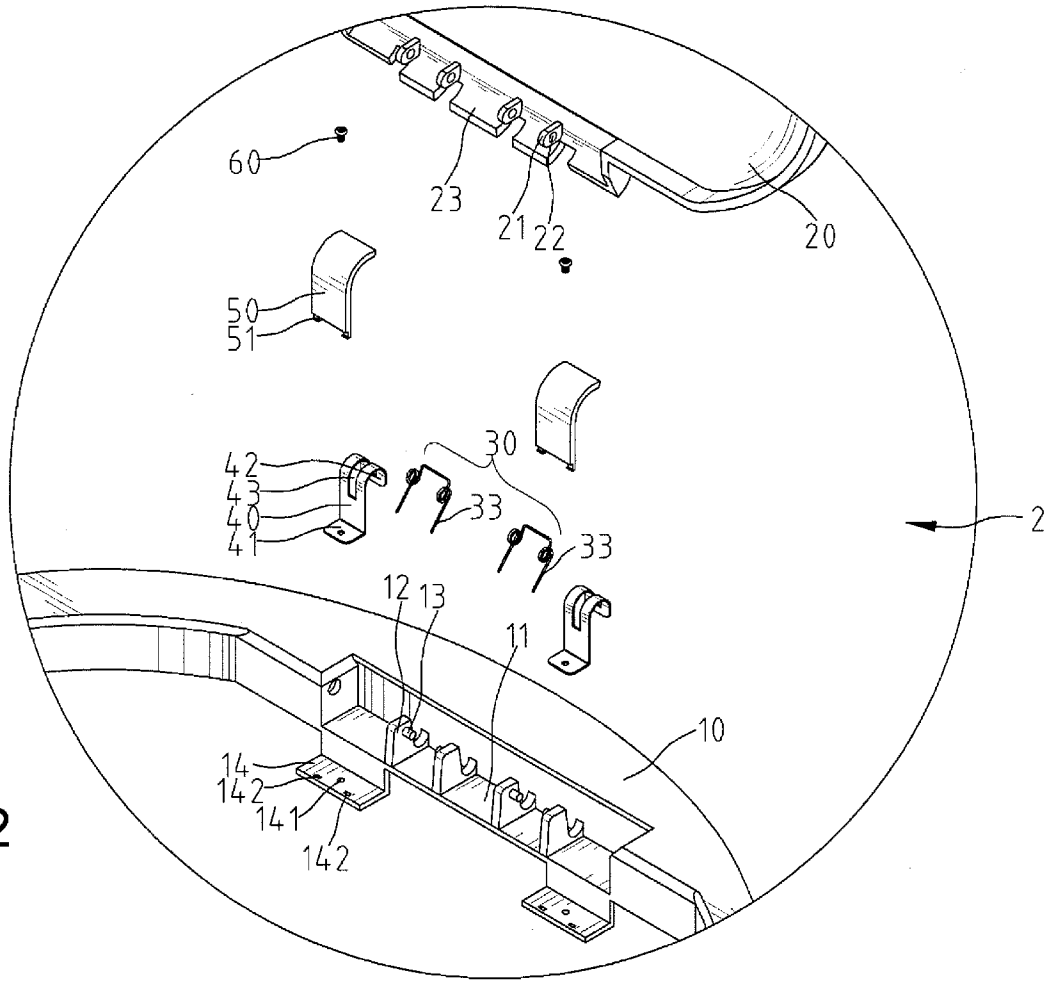
FIG. 2 is an enlarged exploded partial view of the cover set shown in FIG. 1, and shows that the cover set includes a ring, a cover pivotally connected to the ring, a lifting device for lifting the cover from the ring and two buffers for buffering the cover during the end of the lifting.

Referring to FIG. 2, the ring 10 includes a platform 11 formed on an internal side of the ring 10 and located lower than an upper face of the ring 10, four ears 12 formed on the platform 11 and two plates 14 projected from the internal side of the ring 10 and located lower than the platform 11. Each of the ears 12 is formed with a boss 13. Each of the plates 14 defines a screw hole 141 and two apertures 142.

The cover 20 is formed with four ears 21 for pivotal connection to the ears 12 and an extensive portion 23 for contact with the buffers 40. Each of the ears 21 defines an aperture 22 for receiving a related one of the bosses 13. Hence, the cover 20 is pivotally connected to the ring 10.

The lifting device 30 includes two torque springs 33. Each of the torque springs 33 includes two looped portions each arranged around a related one of the bosses 13. Therefore, the lifting device 30 can lift the cover 20 from the ring 10.

Each of the buffers 40 includes a bent portion 41 mounted on a related one of the plates 14 and a curved portion 42 for contact with the extensive portion 23 of the cover 20. A slot 43 is defined in the curved portion 42 of each of the buffers 40 so that the flexibility of the latter is improved.

A threaded bolt 60 is driven in the screw hole 141 of each of the plates 14 through an aperture defined in the bent portion 41 of a related one of the buffers 40. Thus, the buffers 40 are secured to the plates 14.

Each of the shields 50 includes two hooks 51 each inserted in a related one of the apertures 142 of a related one of the plates 14. Hence, the shields 50 are secured to the plates 14. The shields 50 shield the buffers 40 from a side while the ring 10 shields the buffers 40 from another side.

Figure 3:
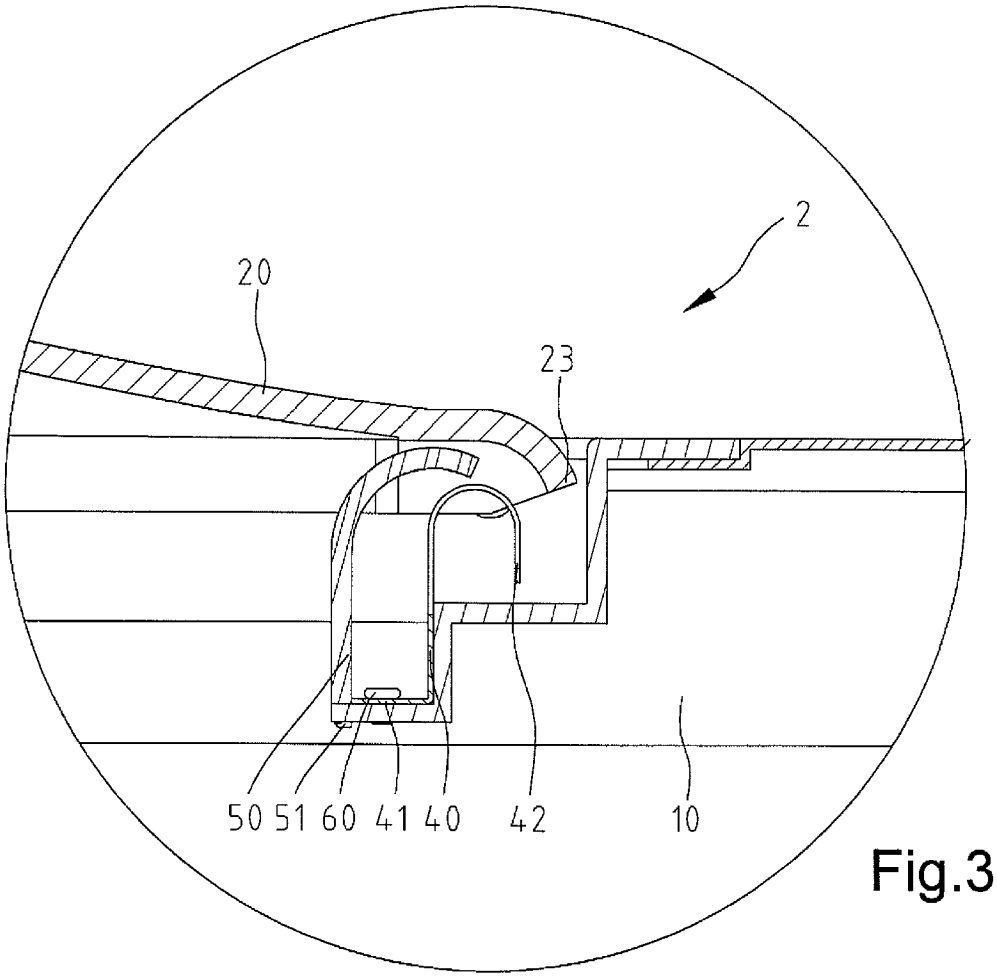
FIG. 3 is a cross-sectional partial view of the cover set of FIG. 1.

Referring to FIG. 3, the cover 20 is lifted from the ring 10. The pivoting of the cover 20 gets faster and faster.

Figure 4:
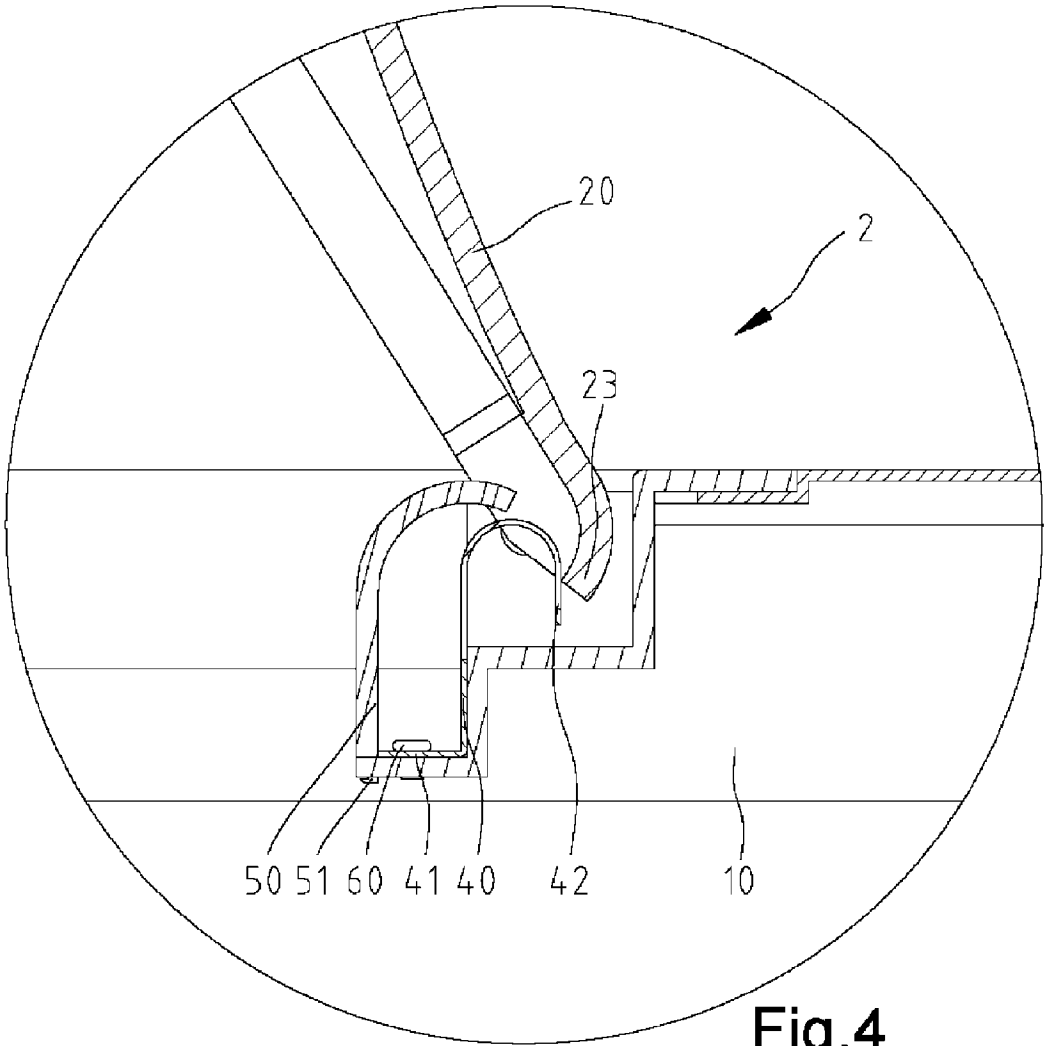
FIG. 4 is a cross-sectional partial view of the cover set in another position than shown in FIG. 3.
Figure 5:
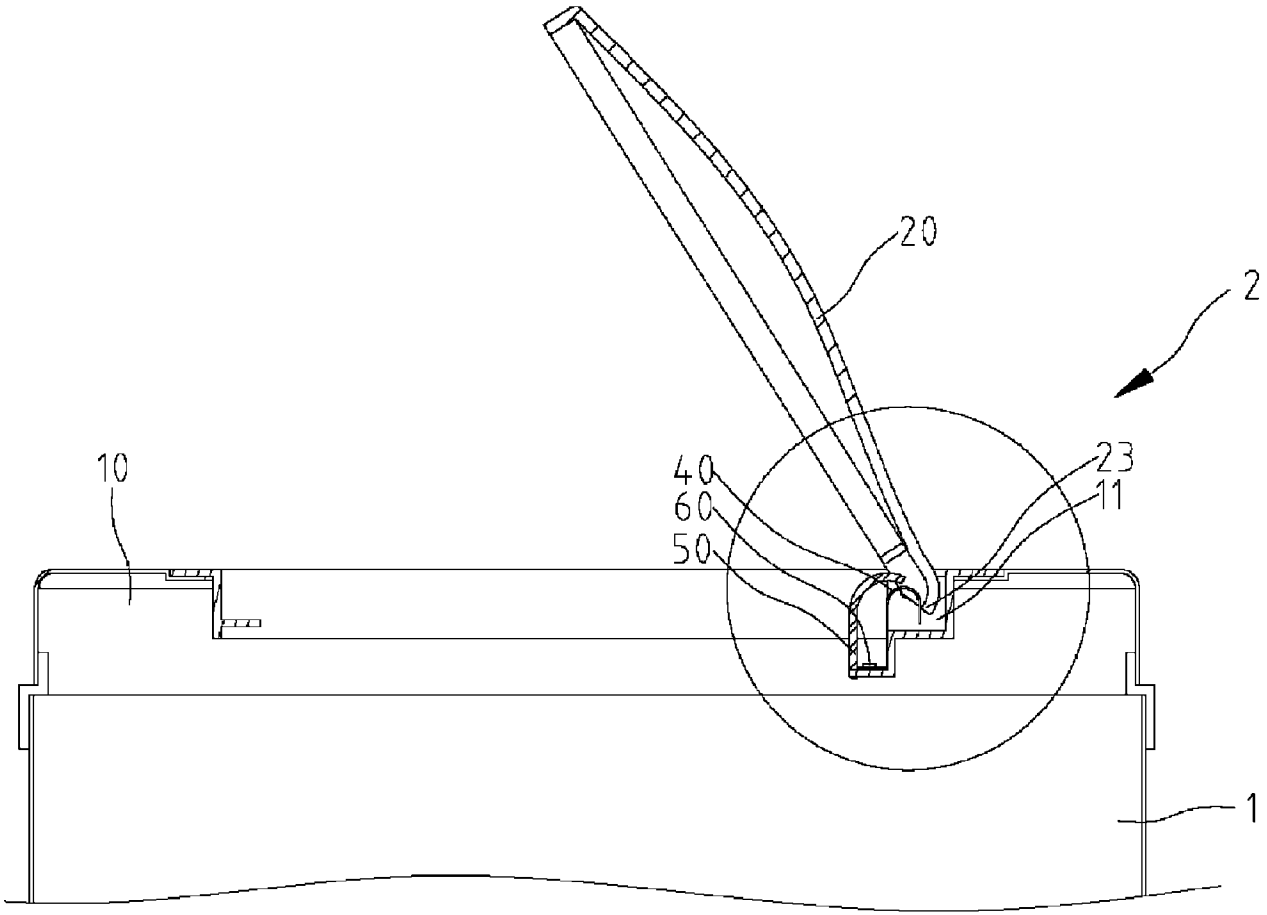
FIG. 5 is a reduced cross-sectional view of the cover set of FIG. 4.

Referring to FIGS. 4 and 5, near the end of the lifting, the pivoting of the cover 20 reaches its top speed, the extensive portion 23 of the cover 20 begins to contact the curved portions 42 of the buffers 40.

Figure 6:
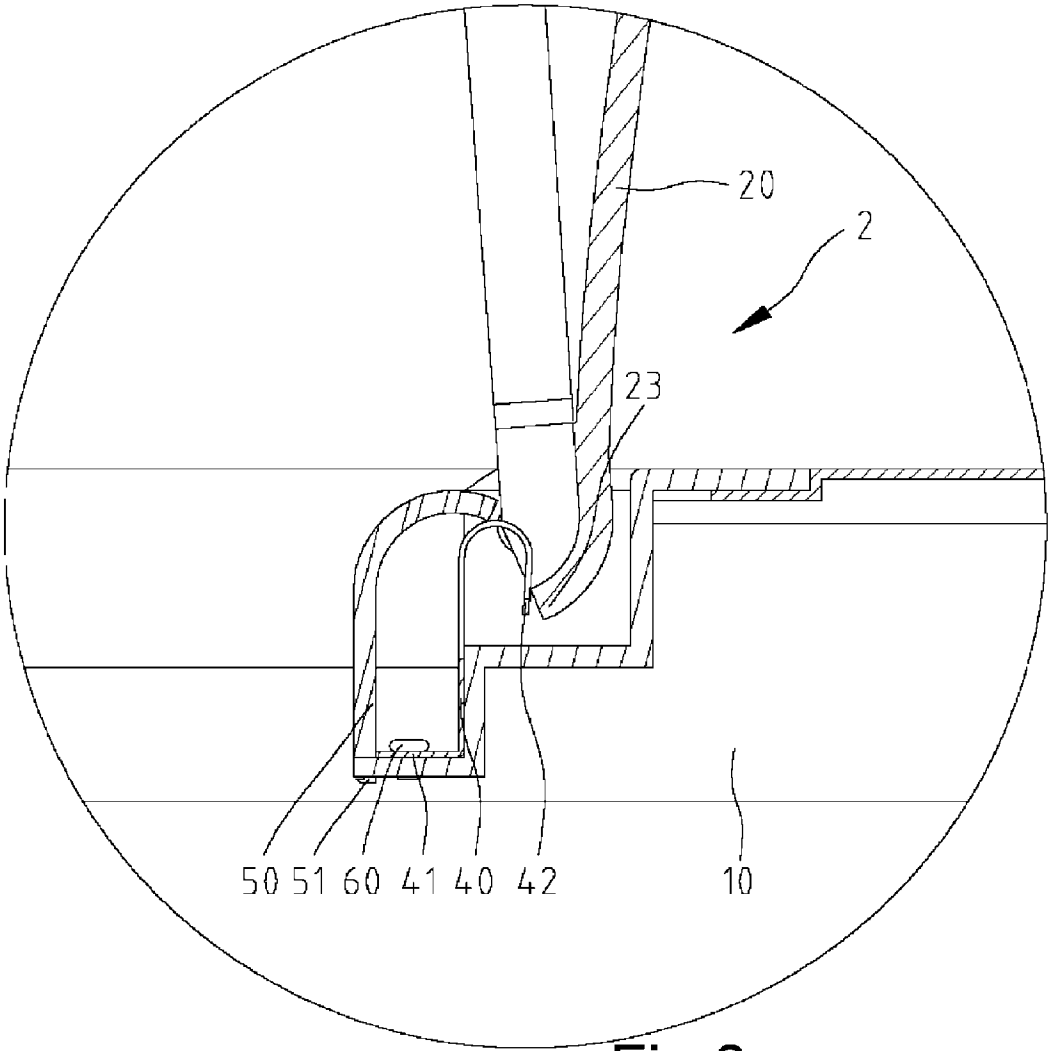
FIG. 6 is a cross-sectional partial view of the cover set in another position than shown in FIG. 4.
Figure 7:
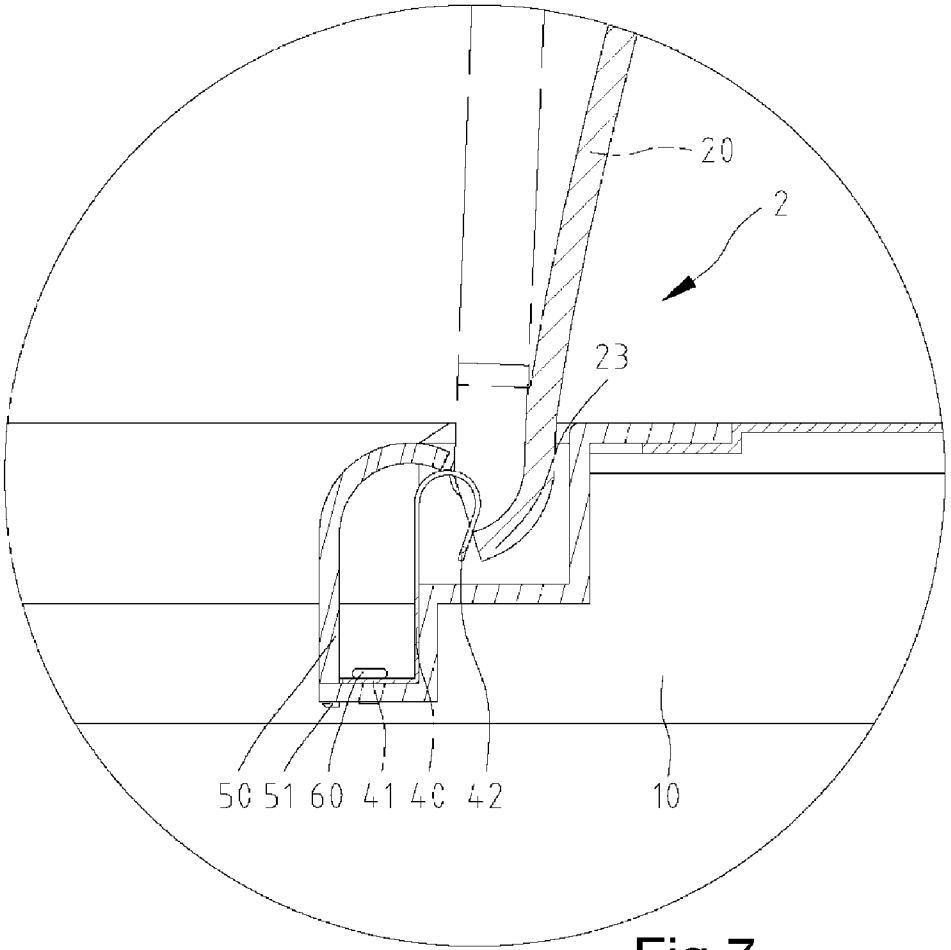
FIG. 7 is a cross-sectional partial view of the cover set in another position than shown in FIG. 6.

Referring to FIGS. 6 and 7, the extensive portion 23 of the cover 20 pushes the curved portions 42 of the buffers 40. The speed of the pivoting of the cover 20 is reduced. Therefore, the cover 20 is buffered by the buffers 40. The cover 20 does not hit the ring 10 and does not make any noise. The lifting of the cover set is steady and quiet.

Figure 8:
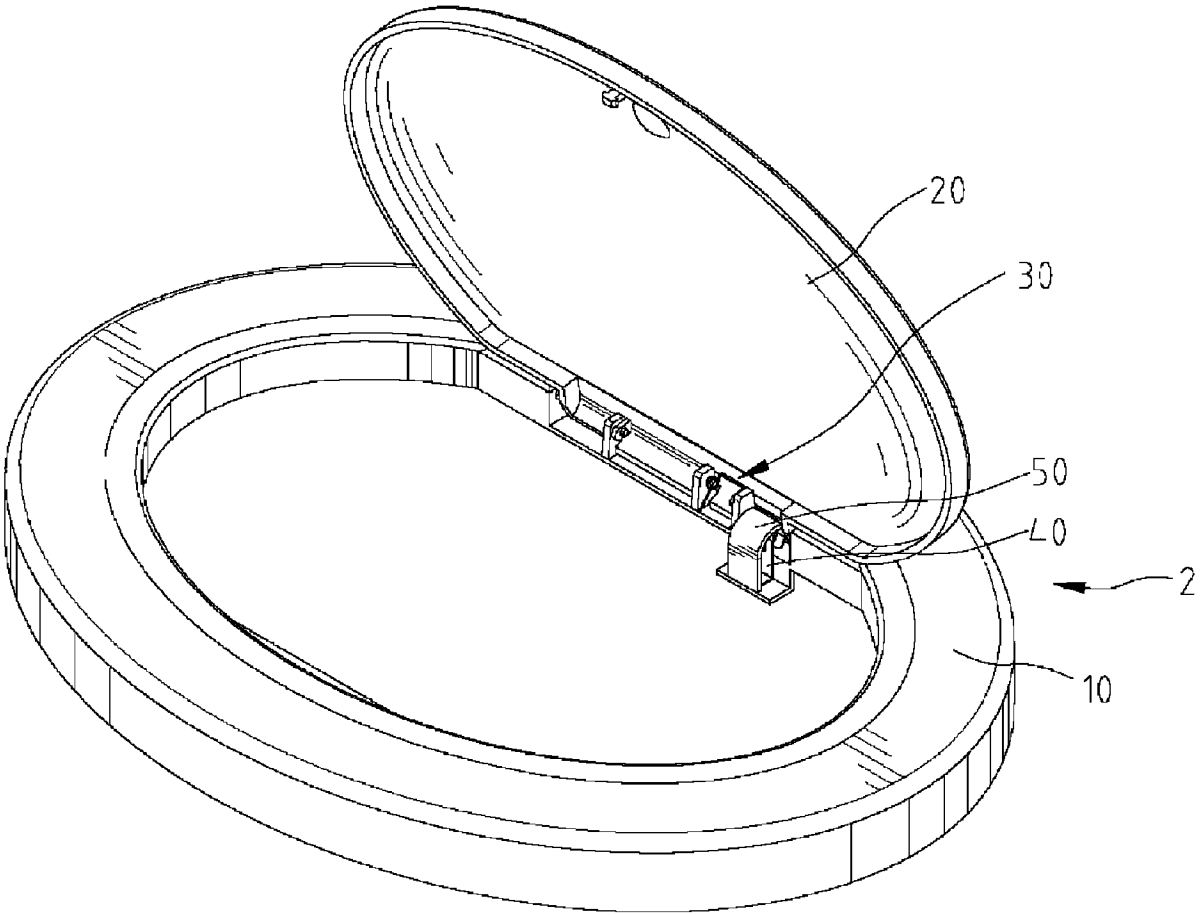
FIG. 8 is a perspective view of a garbage-containing apparatus equipped with a cover set according to the second embodiment of the present invention.

Referring to FIG. 8, there is shown a cover set 2 according to a second embodiment of the present invention. The second embodiment is like the first embodiment except including only one buffer 40 and only one shield 50.

Figure 9:
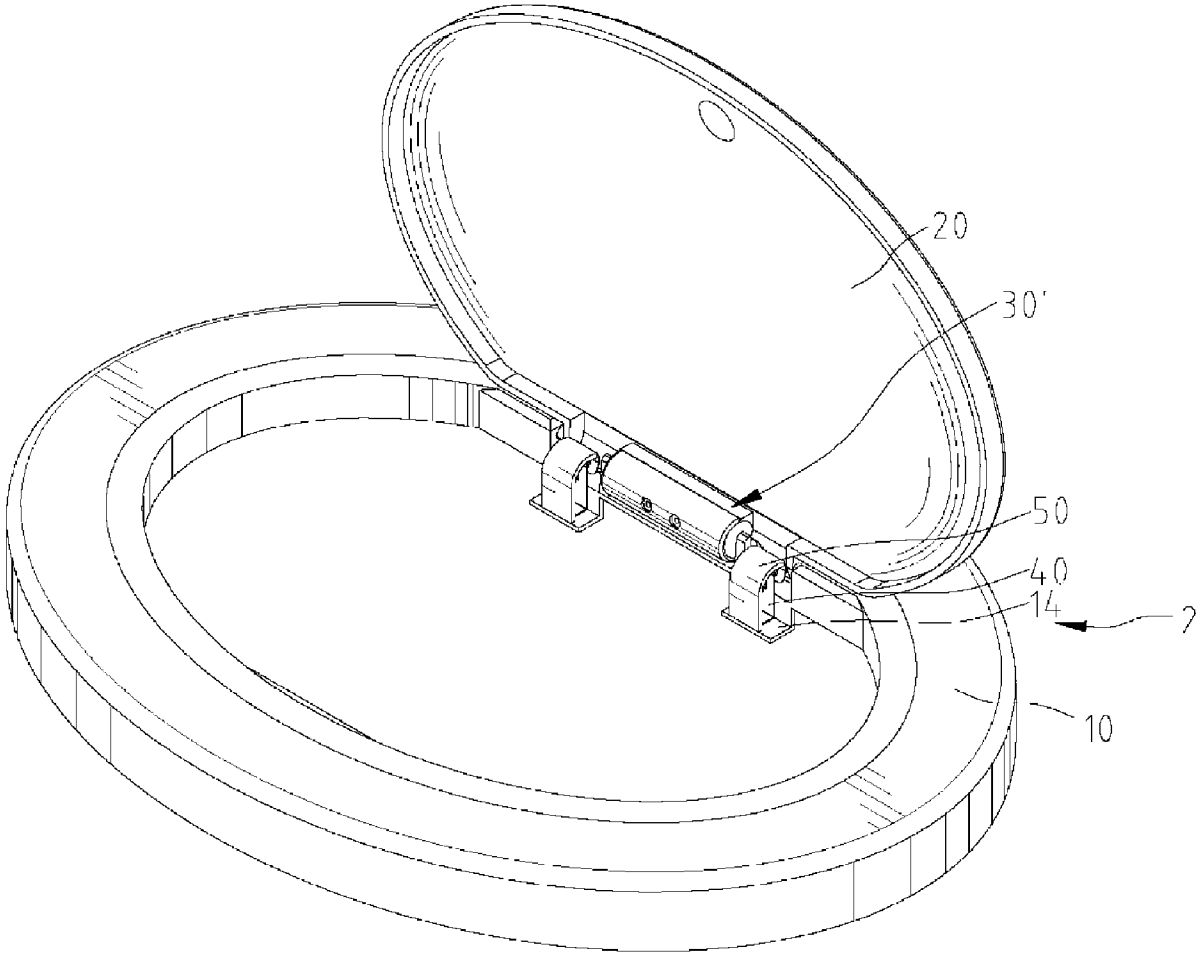
FIG. 9 is a perspective view of a garbage-containing apparatus equipped with a cover set according to the third embodiment of the present invention.
Figure 10:
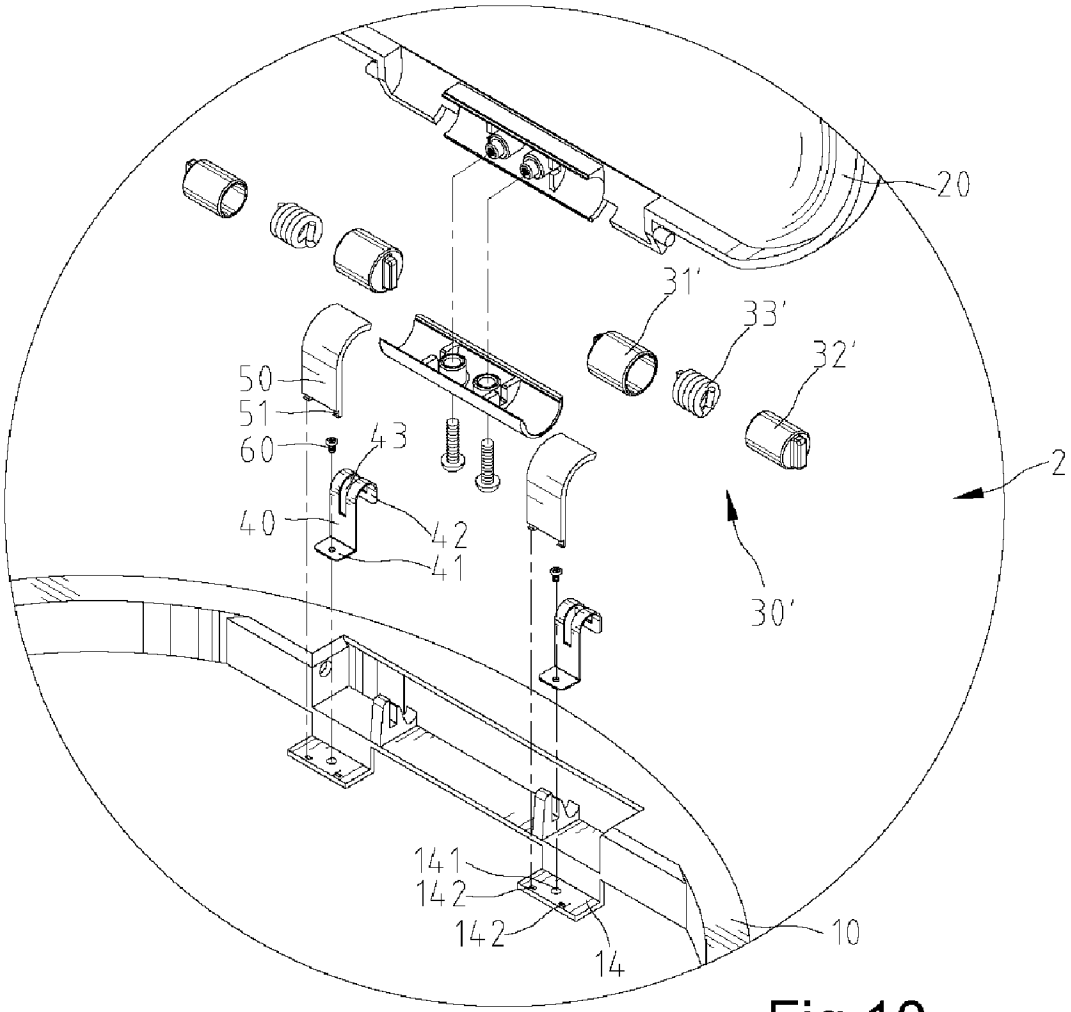
FIG. 10 is an enlarged exploded view of the cover set shown in FIG. 9.
Figure 11:
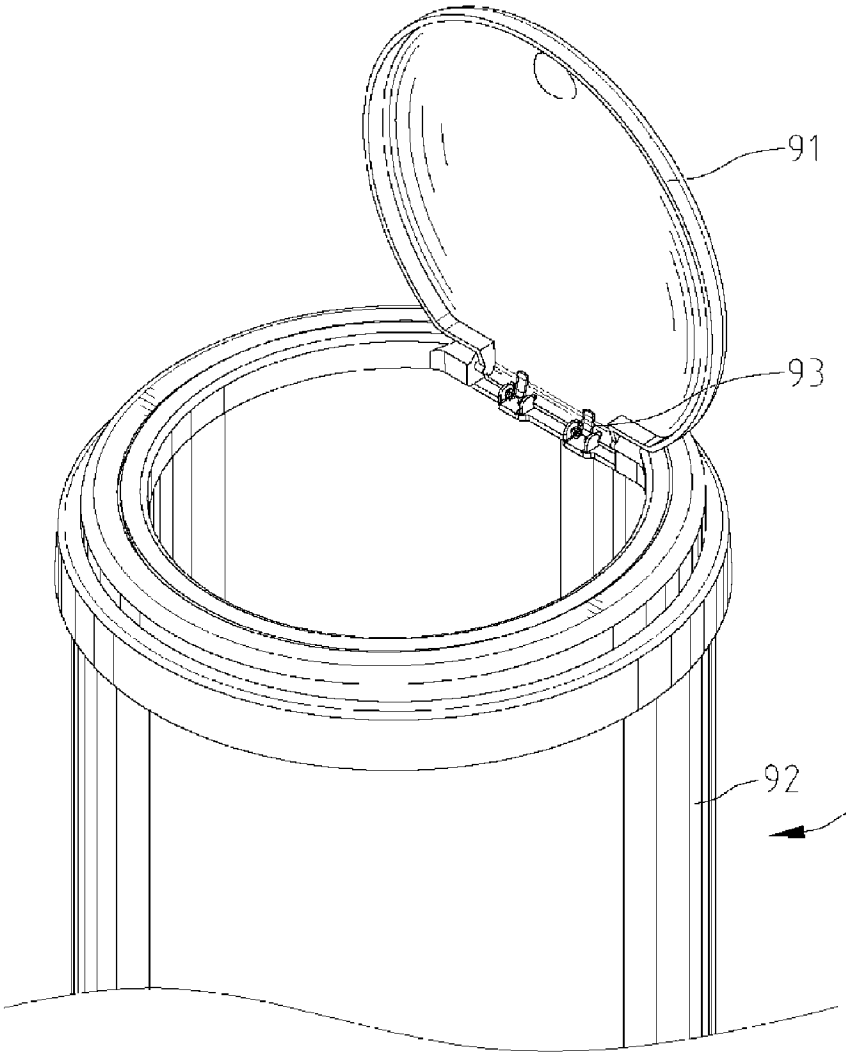
Fig.11 PRIOR ART
FIG. 11 is a perspective view of a conventional garbage-containing apparatus.

Referring to FIGS. 9 and 10, there is shown a cover set 2 according to a third embodiment of the present invention. The third embodiment is like the first embodiment except including a lifting device 30' instead of the lifting device 30. The lifting device 30' includes two units each including a first cap 31' connected to the ring 10, a second cap 32' connected to the cover 20 and a helical spring 33' with an end connected to the first cap 31' and another end connected to the second cap 32'.

In each of the units, the helical spring 33 is substantially not loaded when the cover 20 is lifted from the ring 10 and loaded as the cover 20 is lowered onto the ring 10. Thus, the lifting device 30' is used to lift the cover 20 from the ring 10.

The garbage-containing apparatus according to the present invention exhibits at least two advantages. Firstly, the lifting of the cover 20 from the ring 10 is steady and quiet from the start to the end. Secondly, the buffers 40 are durable, since they are protected by the shields 50.

The present invention has been described through the illustration of the embodiments. Those skilled in the art can derive variations from the embodiments without departing from the scope of the present invention. Therefore, the embodiments shall not limit the scope of the present invention defined in the claims.

What is claimed is:

1. A cover set comprising: a bin; a ring mounted on the bin; a cover pivotally connected to the ring and moveable from a closed position to an open position; a lifting device lifting the cover from the ring to the open position; and at least one buffer comprising a first portion mounted to one of the cover and the ring, with the buffer further comprising a second portion, wherein the second portion of the at least one buffer includes a curved portion between the first portion and a leg terminating in an end, with the curved portion having a flexibility, with the first portion, curved portion and leg defining a U-shape, with the leg contacting another of the cover and the ring in the open position for buffering the cover near the end of the lifting, with the leg of the second portion of the at least one buffer not being in contact with the other of the cover and the ring in the closed position, with the curved portion flexing to move the end of the leg closer towards the first portion as the cover moves to the open position when the buffer contacts the other of the cover and the ring.

2. The cover set according to claim 1 further comprising a slot defined in the curved portion of the at least one buffer, with the slot improving the flexibility of the curved portion.

3. The cover set according to claim 1 wherein the first portion of the at least one buffer includes a bent portion mounted to the one of the cover and the ring.

4. The cover set according to claim 3 wherein the ring comprises at least one plate formed on an internal side supporting the bent portion of the at least one buffer.

5. The cover set according to claim 4 comprising a fastener fastening the bent portion of the at least one buffer to the plate.

6. The cover set according to claim 5 wherein the fastener is a threaded bolt, and the plate defines a screw hole receiving the threaded bolt.

7. The cover set according to claim 4 comprising at least one shield installed on the plate for shielding the at least one buffer, with the cover moving relative to the at least one shield.

8. The cover set according to claim 7 wherein the shield comprises at least one hook, and the plate defines at least one aperture for receiving the hook.

9. The cover set according to claim 1 wherein the lifting device comprises at least one torque spring arranged between the ring and the cover.

10. The cover set according to claim 1 wherein the lifting device comprises at least one torque-providing unit arranged between the ring and the cover.

11. The cover set according to claim 10 wherein the torque-providing unit comprises a first cap connected to the ring, a second cap connected to the cover and a helical spring with an end attached to the first cap and another end attached to the second cap.

12. The cover set according to claim 1 wherein the ring comprises a plurality of ears formed thereon, and the cover comprises a corresponding number of ears pivotally connected to the ears of the ring.

13. The cover set according to claim 12 wherein each of the ears of the ring comprises a boss, and each of the ears of the cover defines an aperture for receiving the boss of a related one of the ears of the ring.

14. The cover set according to claim 7 wherein the at least one shield includes a curved portion extending over the curved portion of the at least one buffer, with the curved portion of the at least one shield abutting the curved portion of the at least one buffer when the cover is in the open position, with the cover being spaced from the at least one shield.

15. The cover set according to claim 14 wherein the cover includes an extensive portion of an arcuate shape, with the second portion of the at least one buffer contacting the extensive portion in the open position, with the extensive portion not being in contact with the second portion of the at least one buffer in the closed portion.

16. The cover set according to claim 2 wherein the cover includes an extensive portion of an arcuate shape, with the second portion of the at least one buffer contacting the extensive portion in the open position, with the extensive portion not being in contact with the second portion of the at least one buffer in the closed portion.

17. The cover set according to claim 1 wherein the cover includes an extensive portion of an arcuate shape, with the second portion of the at least one buffer contacting the extensive portion in the open position, with the extensive portion not being in contact with the second portion of the at least one buffer in the closed portion.

* * * * *